US006425315B1

(12) United States Patent
Kaneko et al.

(10) Patent No.: US 6,425,315 B1
(45) Date of Patent: Jul. 30, 2002

(54) SEAL STRUCTURE FOR RODLESS CYLINDER

(75) Inventors: Junya Kaneko, Abiko; Hideho Koyama, Ryugasaki, both of (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/688,164

(22) Filed: Oct. 16, 2000

(30) Foreign Application Priority Data

Oct. 18, 1999 (JP) ..... 11-296018

(51) Int. Cl.[7] ..... F01B 29/00; F01B 11/02

(52) U.S. Cl. ..... 92/88; 92/169.1

(58) Field of Search ..... 92/88, 169.1

(56) References Cited

U.S. PATENT DOCUMENTS 5,606,903 A * 3/1997 Drittel ..... 92/88

* cited by examiner

*Primary Examiner*—F. Daniel Lopez
*Assistant Examiner*—Michael Leslie
(74) *Attorney, Agent, or Firm*—Paul A. Guss

(57) ABSTRACT

A seal member includes a first seal portion inscribed on the outer circumferential surface of a small projection in an end cover, a second seal portion circumscribed around the inner surface of a cylinder tube, and a size expanded portion continuing from said second seal portion.

5 Claims, 7 Drawing Sheets

PRIOR ART

SEAL STRUCTURE FOR RODLESS CYLINDER

BACKGROUND OF THE INVENTION

1. Field of the Invention

The present invention relates to a rodless cylinder, and more specifically to a seal structure for a rodless cylinder in which an opening of a cylinder tube is sealed by an end cover.

2. Description of the Related Art

A general overview of a conventional seal structure for a rodless cylinder is given in FIG. 7.

As can be seen from FIG. 7, a reciprocating piston 14 is fitted into a cylinder 12 of a rodless cylinder 10, and the cylinder tube 12 has openings on both ends (only an opening on one end side is shown in FIG. 7) blocked by end covers 22 each having a cushion ring 20 in communication with a pressurizing fluid inlet/outlet hole 18. The piston 14 is fitted with a piston packing 16 to seal the leakage of a pressurizing fluid acting upon the piston 14. The piston packing 16 is provided in close contact with the inner circumferential surface of the cylinder tube 12 and a seal belt 24 having its both ends rigidly attached to the end covers 22.

Meanwhile, in the seal structure to seal the opening of the cylinder tube 12 by the end cover 22, a boss portion 22*a* having a similar shape to the inner circumferential shape of the cylinder tube 12 is projected to the end cover 22, and a seal member 28 is mounted to an outer circumferential groove 26 formed by machining using a lathe for example at the mid position of the outer circumferential surface of the boss portion 22*a*.

Note however that in this conventional seal structure for the rodless cylinder 10, the size in the longitudinal direction must be reduced in order to reduce the entire size. Furthermore, the work to form the outer circumferential groove 26 at the boss portion 22*a* has kept the manufacturing process from being simplified for reducing the manufacturing cost.

SUMMARY OF THE INVENTION

It is a general object of the present invention to provide a seal structure for a rodless cylinder which allows the size and manufacturing cost to be reduced by shortening the boss portion of an end cover blocking a cylinder tube and by removing the outer circumferential groove otherwise formed in the boss portion to fit a seal member.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
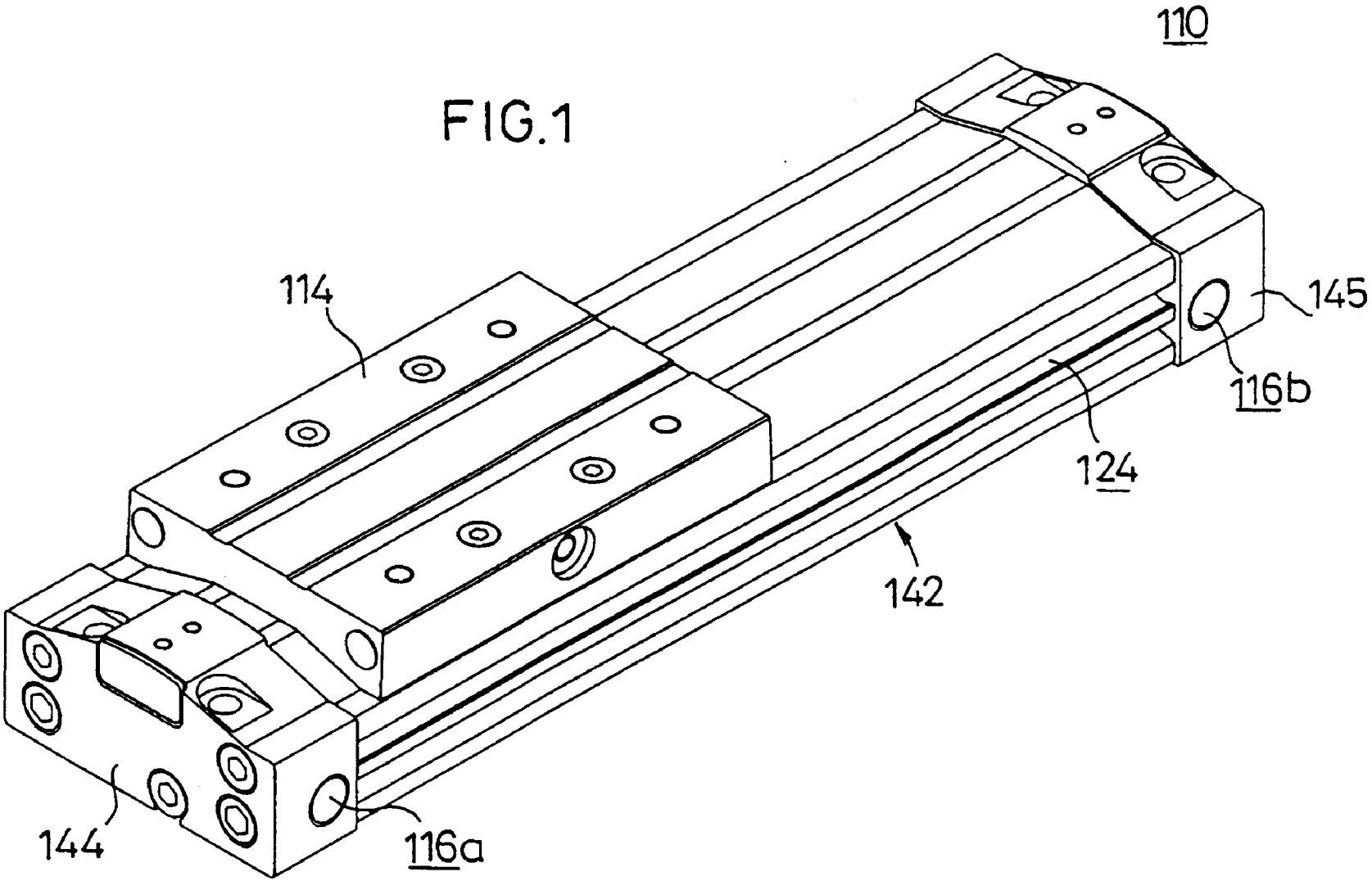
FIG. 1 is a perspective view of a rodless cylinder to which a seal structure for a rodless cylinder according to a first embodiment of the present invention is applied.

A rodless cylinder to which a seal structure for a rodless cylinder according to an embodiment of the present invention is applied is shown in FIG. 1.

A rodless cylinder 110 includes an elongated cylinder tube 142, a slide table 114 attached to the cylinder tube 142 and capable of reciprocating in the longitudinal direction, and a pair of end covers 144, 145 attached to the ends of the cylinder tube 142 in the longitudinal direction and provided with fluid pressure outlet/inlet ports 116*a*, 116*b*.

Figure 2:
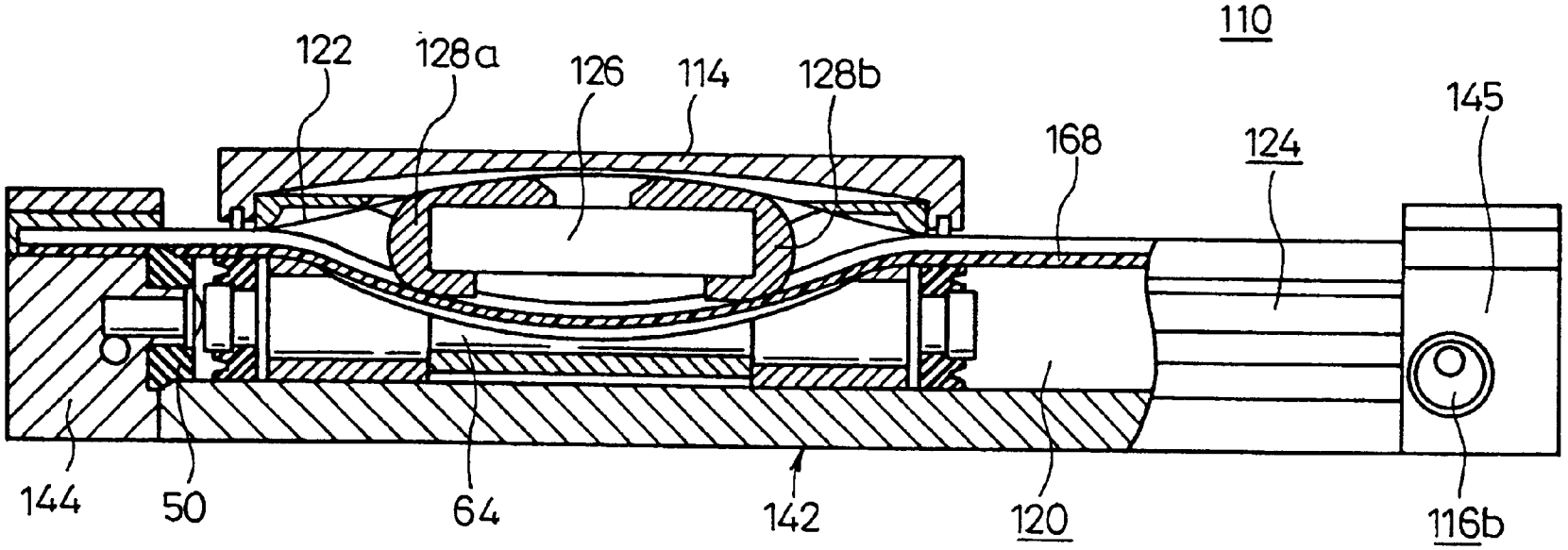
FIG. 2 is a partly vertical sectional view of the rodless cylinder in the longitudinal direction.

In the cylinder tube 142, as shown in FIG. 2, there is formed a bore 120 extending in the longitudinal direction and in communication with the outside through a slit (not shown) formed at the upper surface of the cylinder tube 142. The slit is sealed in an airtight manner by a dust seal belt 122 and a seal belt 168 extending in the longitudinal direction of the cylinder tube 142 and engaged by the pair of end covers 144, 145.

At both side surfaces of the cylinder tube 142, as shown in FIG. 1, an elongate groove 124 for attaching a sensor is formed in the longitudinal direction. The elongate groove 124 is provided with a sensor (not shown) for detecting the position of a piston 64 which will be described. Note that the elongate groove 124 may also be used as a groove for securing a stopper member which is not shown.

As shown in FIG. 2, the piston 64 is provided with a piston yoke 126 which projects toward the upper side. At both upper ends of the piston yoke 126, a pair of belt separators 128*a*, 128*b* are attached at prescribed distance apart from one another. The piston 64 is coupled with the slide table 114 so as to cover the piston yoke 126 and the belt separators 128*a*, 128*b*. In this case, the slide table 114 is in contact with the upper surface of the cylinder tube 142 for example through a guide mechanism which is not shown.

Figure 3:
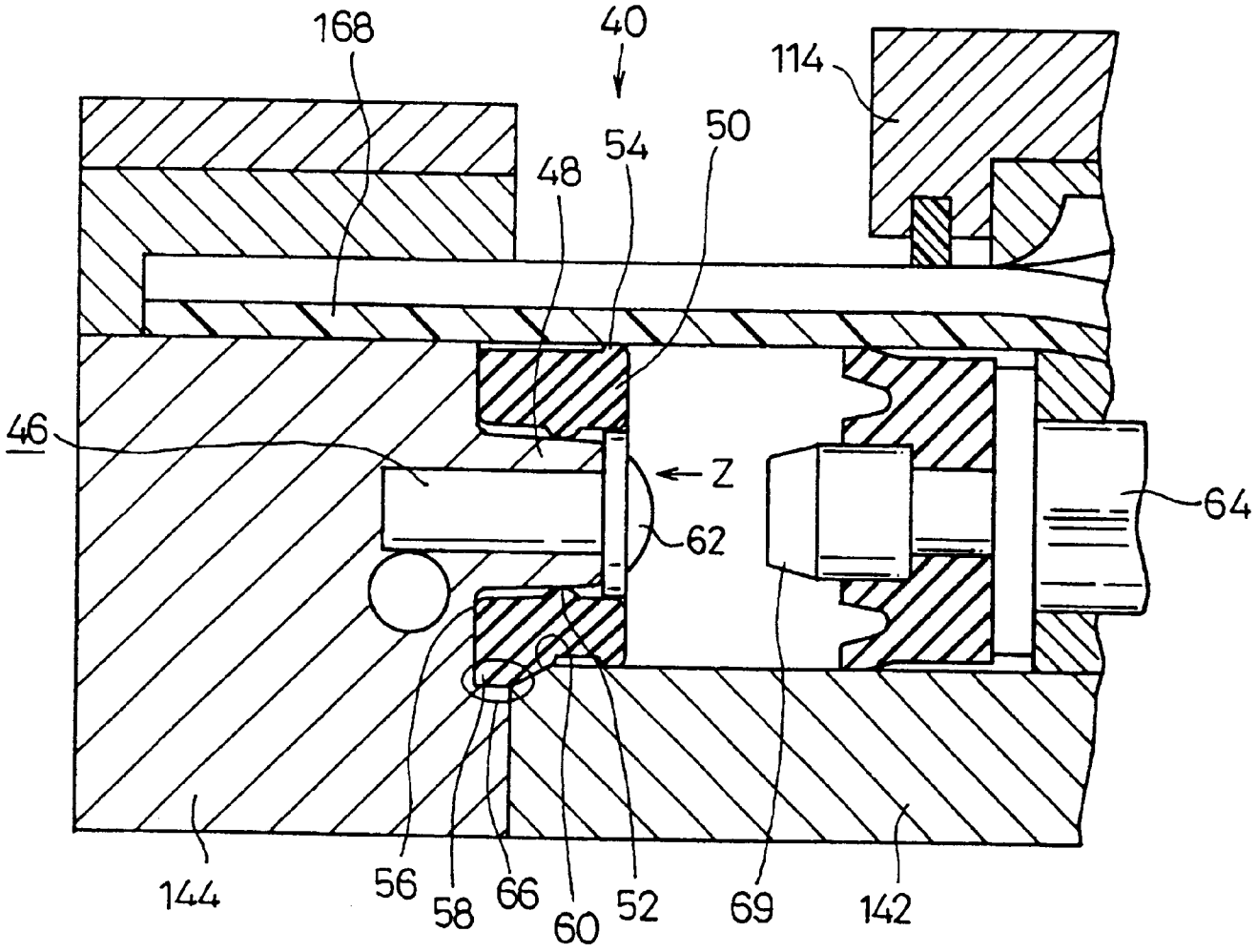
FIG. 3 is a partly omitted, vertical sectional view of the seal structure for a rodless cylinder according to the first embodiment.

A seal structure 40 for a rodless cylinder according to the embodiment is shown in FIG. 3. In FIG. 3, about in the center of the end cover 144 joined to an opening on one end side of the cylinder tube 142, a small projection 48 having a pressurizing fluid inlet/outlet hole 46 is provided. At the outer circumferential surface of the small projection 48, a seal member 50 integrally formed by an elastic body such as a rubber material is fitted.

Figure 4:
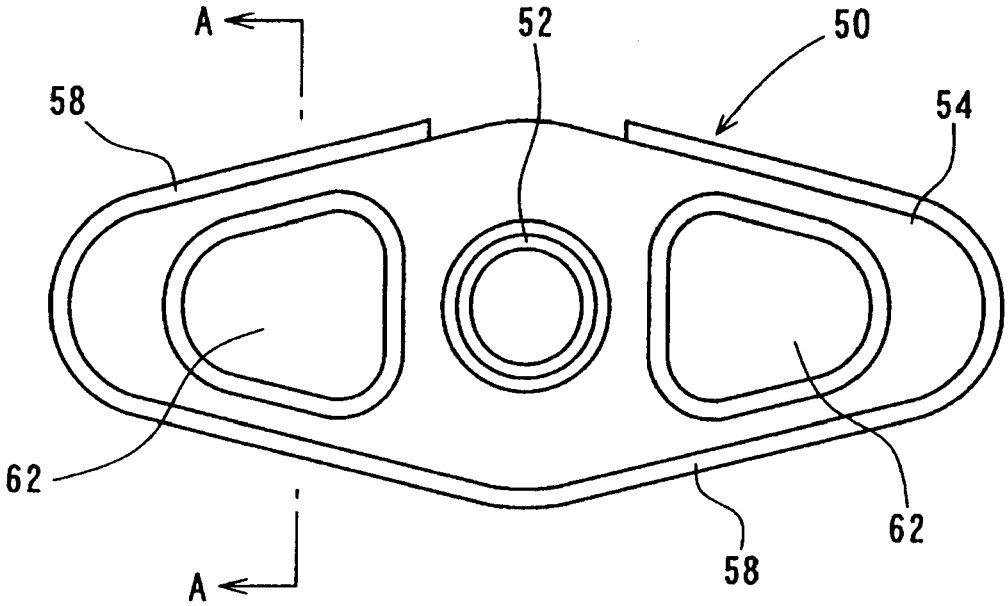
FIG. 4 is a view of an outer shape of the seal member viewed in the direction of the arrow Z in FIG. 3.

As shown in FIG. 4, the seal member 50 is formed to have a shape similar to the approximately rhombic cross section of the bore 120 of the cylinder tube 142. The seal member 50 is also provided with an annular, first seal portion 52 inscribed on the outer circumferential surface of the small projection 48 of the end cover 144, a second seal portion 54 in an approximately annular shape circumscribed around the inner wall surface of the cylinder tube 142, and a size expanded portion 58 continuing from the second seal portion 54 to join with a recessed surface 56 of the end cover 144 (see FIG. 5). The size expanded portion 58 may preferably be formed to have a shape similar to a shape defined by the recessed surface 56 of the end cover 144 and the opening chamfered portion 60 of the cylinder tube 142. Thus, the fitting relation can be secured at a chamfered pocket portion 66 defined by a joining surface between the size expanded portion 58 of the seal member 50 and the opening chamfered portion 60 of the cylinder tube 142 when the end cover 144 is joined to the cylinder tube 142.

Figure 5:
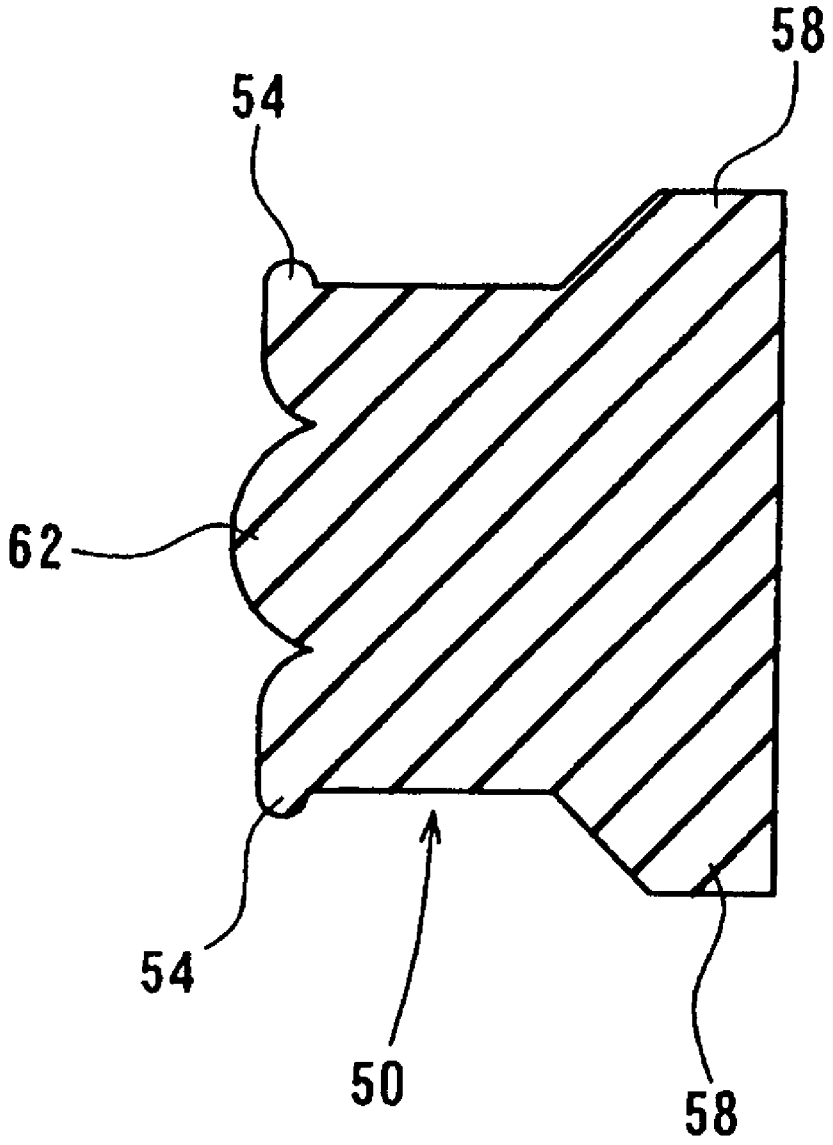
FIG. 5 is a vertical sectional view taken along line A—A in FIG. 4.

Furthermore, the seal member 50 has a damper function to buffer impact applied by the piston 64 by providing a projection 62 having an approximately half spherical cross section on both sides of the first seal portion 52 as shown in FIGS. 4 and 5. Note that the cross section of the projection 62 is not limited to the half spherical shape, but a bar shape or a conical shape may be employed. Both ends of the seal belt 168 are fastened by the pair of end covers 144 and 145 using bolts which are not shown.

The rodless cylinder 110 with the seal structure 40 for a rodless cylinder according to the present embodiment basically has the above-described structure, and the operation, function and effect will be now described.

When a pressurizing fluid such as compressed air is introduced from the pressurizing fluid inlet/outlet hole 46, the piston 64 moves to the right in FIG. 3. In this case, the joining surface between the cylinder tube 142 and the end cover 144 is held in an airtight manner by the size expanded portion 58 of the seal member 50, the chamfered pocket portion 66 formed by the opening chamfered portion 60 of the cylinder tube 142, the first seal portion 52 inscribed on the outer circumference of the small projection 48 of the end cover 144, and the second seal portion 54 circumscribed around the inner surface of the cylinder tube 142.

When the piston 64 moves to the left to the stroke end in FIG. 3, the head 69 of the piston 64 abuts against the projection 62 and the impact applied by the piston 64 can be absorbed. The seal member 50 can also have two functions, i.e., a seal function and a damper function if a selected material has preferable characteristics regarding sealing, irregularities in shape in the thickness-wise direction (the moving direction of the piston), impact absorption and the like.

The shape of the seal member 50 according to the present embodiment is not limited to the approximately rhombic shape, and a circular shape, an ellipse shape or the like may be similarly employed.

Figure 6:
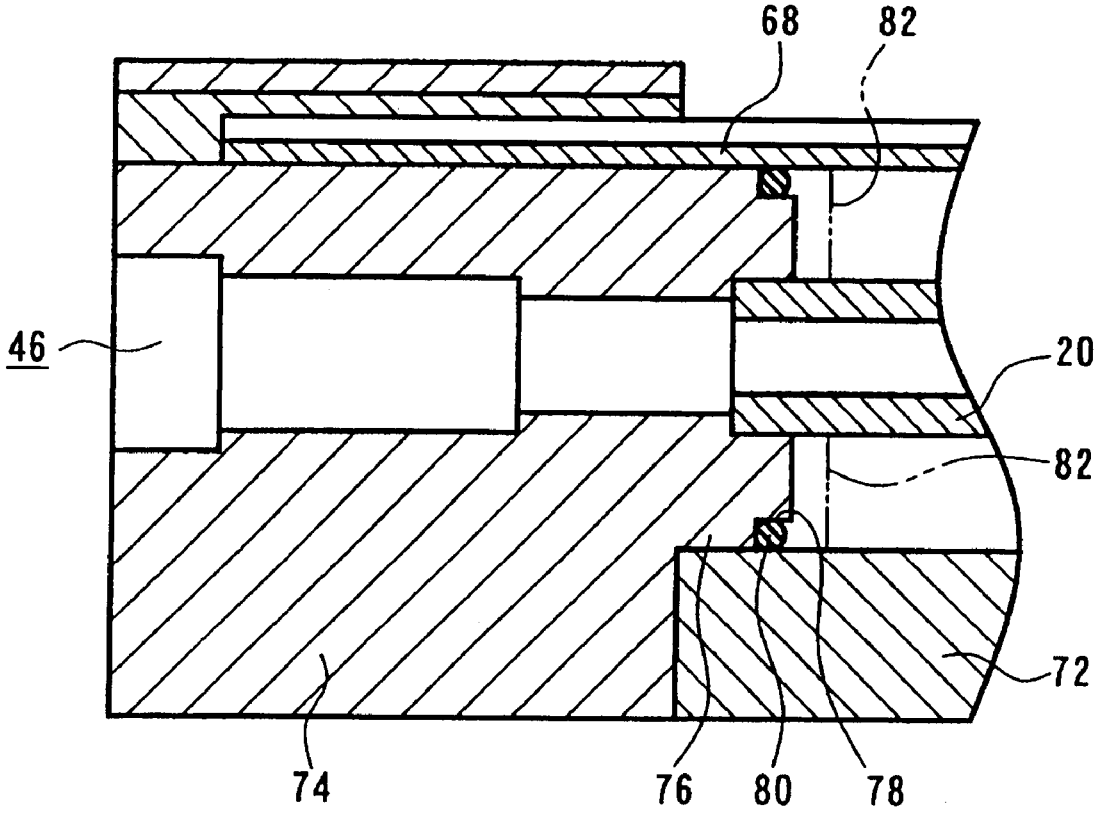
FIG. 6 is a schematic view of a seal structure for a rodless cylinder according to a second embodiment of the present invention.
Figure 7:
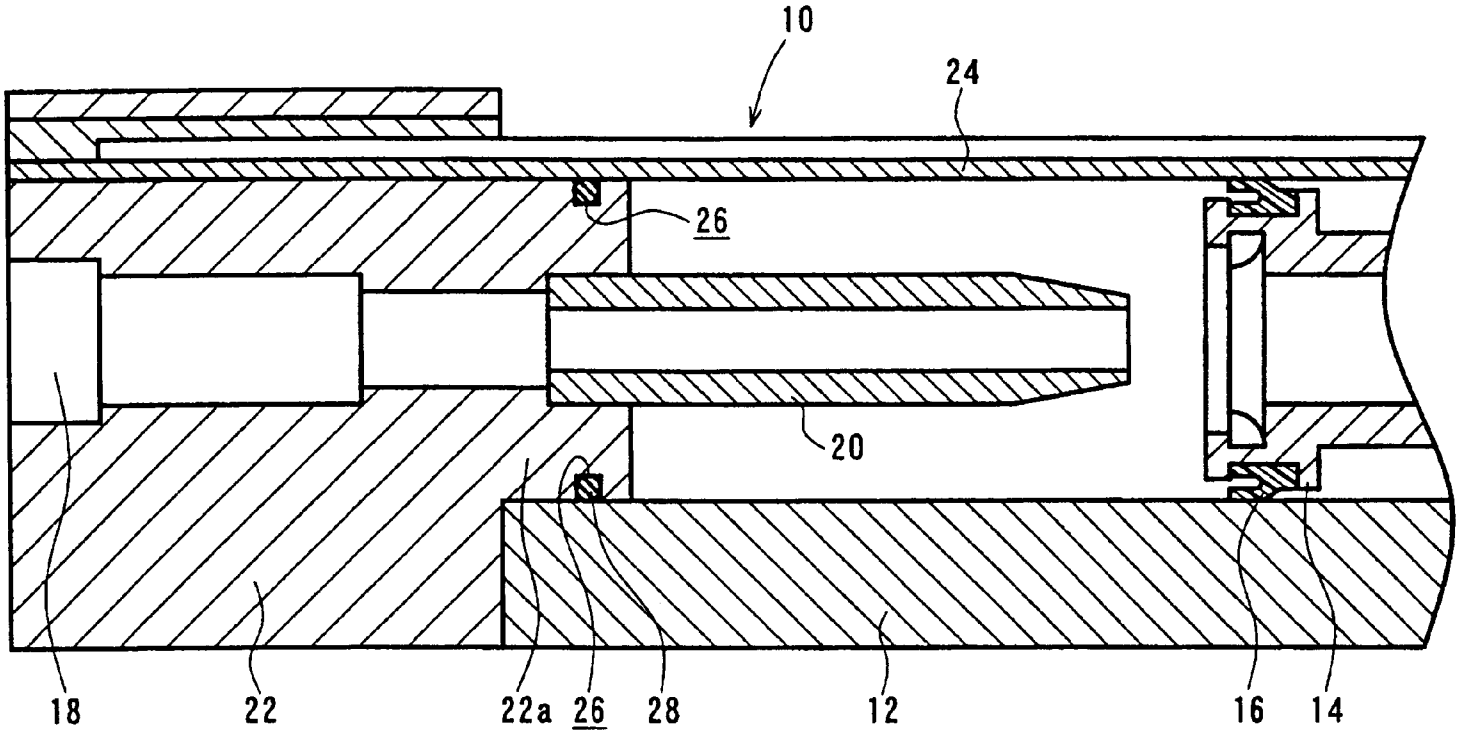
FIG. 7 is a schematic vertical sectional view of a conventional seal structure for a rodless cylinder.

A second embodiment of the present invention will be now described in conjunction with FIG. 6. As shown in FIG. 6, in a seal structure in which a cylinder tube 72 with a circular inner surface has an opening sealed by an end cover 74, a stepped portion 78 is provided at an end surface of a boss portion 76 having a similar shape to the inner surface shape of the cylinder tube 72, and a seal member 80 is mounted to the outer circumferential surface of the stepped portion 78, so that the projecting length of the boss portion 76 can be reduced.

According to the second embodiment, a shoulder portion 82 forming the outer circumferential groove 26 is removed, to which the seal member 80 is supposed to be fitted, so that the size of the end cover 74 in the longitudinal direction can be reduced.

Furthermore, when the end cover 74 is formed by casting such as die casting and lost wax process using segment dies (not shown), the shape of the groove to fit in the seal member 80 can be changed into the shape of the stepped portion 78 instead of the shape of the outer circumferential groove 26 in the conventional case. As a result, a die structure without a die segmental plane can be provided, so that the end cover 74 with the stepped portion 78 can be subjected to mass production. Note that the annular shape of the stepped portion 78 to fit in the seal member 80 is not limited to the circular shape but an ellipse or rectangular shape can be applied.

What is claimed is:

1. A seal structure for a rodless cylinder, said rodless cylinder comprising:

an end cover provided with a pressurizing fluid inlet/outlet hole;

a cylinder tube in which a piston is allowed to reciprocate along a bore by a pressurizing fluid supplied from said pressurizing fluid inlet/outlet hole; and a seal member to seal an opening of said cylinder tube and said end cover, said end cover being provided with a small projection projected on an outer circumferential portion of said pressurizing fluid inlet/outlet hole, said seal member being formed of a plate-shaped elastic body having a first seal portion inscribed on an outer circumferential portion of said small projection, and a second seal portion circumscribed around an inner surface of said cylinder tube.

2. The seal structure for a rodless cylinder according to claim 1, wherein said seal member is provided with the second seal portion circumscribed around the inner surface of said cylinder tube at one side surface, and with a size expanded portion continuing from said second seal portion at another side surface opposite to said one side surface, and said size expanded portion is formed to have a shape similar to a shape of an opening chamfered portion of said cylinder tube, so that a chamfered pocket portion is provided at a joining surface between said end cover and the opening of said cylinder tube.

3. The seal structure for a rodless cylinder according to claim 2, wherein said seal member has an integrally formed projection to absorb impact.

4. The seal structure for a rodless cylinder according to claim 1, wherein said seal member has an approximately rhombic cross section corresponding to a cross sectional shape of the bore of the cylinder tube, and is integrally formed to include said first seal portion and said second seal portion.

5. The seal structure for a rodless cylinder according to claim 4, wherein said first seal portion is provided centrally in said seal member, while said second seal portion is formed along the outer circumferential portion of the approximately rhombic shape.

* * * * *